United States Patent [19]

Edwards

[11] Patent Number: 4,934,554

[45] **Date of Patent: * Jun. 19, 1990**

[54] TAMPER-EVIDENT LID WITH TEAR-AWAY RING

[75] Inventor: Bryant Edwards, 274 Stonegate Rd., Clarendon Hills, Ill. 60514

[73] Assignee: Bryant Edwards, Clarendon Hills, Ill.

[ * ] Notice: The portion of the term of this patent subsequent to Nov. 29, 2005 has been disclaimed.

[21] Appl. No.: 244,118

[22] Filed: Sep. 14, 1988

[51] Int. Cl.[5] ..... B65D 41/02

[52] U.S. Cl. ..... 220/266; 220/270; 220/276; 220/306; 220/307; 215/253; 215/254; 215/256

[58] Field of Search ..... 220/266, 270, 276, 306, 220/307; 215/253, 254, 256

[56] References Cited

U.S. PATENT DOCUMENTS

| | | | |
|---|---|---|---|
| 4,111,329 | 9/1978 | Lampman | 220/266 |
| 4,281,774 | 8/1981 | Mumford | 220/306 |
| 4,476,993 | 10/1984 | Krout | 220/276 |
| 4,602,718 | 7/1986 | Dutt | 215/252 |
| 4,607,759 | 8/1986 | Boetzkes | 220/266 |
| 4,660,735 | 4/1987 | Peschardt et al. | 220/276 |
| 4,682,706 | 7/1987 | DeVore et al. | 220/276 |
| 4,711,364 | 12/1987 | Letica | 220/276 |
| 4,718,571 | 1/1988 | Bordner | 220/270 |
| 4,726,482 | 2/1988 | Barriac | 215/252 |
| 4,730,745 | 3/1988 | Perry | 215/254 |
| 4,787,530 | 11/1988 | Edwards | 220/266 |

*Primary Examiner*—Stephen Marcus
*Assistant Examiner*—Nova Stucker
*Attorney, Agent, or Firm*—Cook, Egan, McFarron & Manzo

[57] ABSTRACT

A tamper-evident lid for use with containers includes a surface to cover the container, and downward projections around the periphery of the surface which surrounds the mouth of said container. An interrupted ring is frangibly attached to the downward projections. A plurality of tamper-evident hooks are affixed to said ring. The hooks are visible through openings in the downward projections. The hooks engage the container, but when the lid is removed, the ring fractures away from the downward projection ring and the tampering with the package is apparent. In the preferred embodiment, a bead on the lid engages the sidewall of the container to provide a resealable, airtight seal.

11 Claims, 6 Drawing Sheets

TAMPER-EVIDENT LID WITH TEAR-AWAY RING

The present invention is directed, in general, to sanitary tamper-evident lids adapted for use in combination with conventional or specially designed containers. More particularly, the present invention relates to lids which include tamper-evident assemblies which fracture away from said lid when the lid is removed or lifted from the mouth of the container, thereby providing visible evidence of tampering with the container. Further, the lids of the present invention can be applied to containers using conventional high speed filling and packaging equipment.

BACKGROUND

A wide variety of container lids, both metal and plastic, have been designed to provide evidence of package tampering and to provide visible evidence that a container has been opened or partially opened. Such lids generally comprise an annular body with a closed end adapted to fit over the mouth of the container. The lids may include a sealing mechanism for engaging the top or side or outside edge of the container mouth to seal it to the container. Some such lids utilize a tear-away strip which is connected to the cap and which must be removed before the cap itself can be removed. Such security strips serve the purpose of providing visible indication of tampering, but they are often difficult to apply to the container using conventional, high speed filling machines and the lids themselves are not easily or economically made. To overcome such disadvantages, lids have been designed with a tamper-evident ring or band members which are secured to the cap. In theory, such bands are broken away from the cap by rotation of the cap in the direction of opening. A large number of such designs have been produced commercially, but they have not been satisfactory because they are not always reliable and they don't always indicate the existence of a broken seal. In other situations, containers with conventional caps applied thereto have been covered with shrink wrapped plastic. Although this is effective, it is not only expensive, but requires additional packaging steps which requires additional equipment and space.

The criteria for an ideal tamper-evident package is as follows:

1. Consumer must clearly see that package is tamper-evident/resistant.
2. Package must eliminate nuisance and/or mischief problems at store levels.
3. Package must be resistant to unsophisticated efforts to open and tamper with it in store.
4. Package must be reclosable at user level with sufficient seal to preserve freshness in home storage.
5. Package must be adaptable to current high-speed filling systems and distribution methods.
6. The method to open package must be relatively simple.
7. Package, if opened, must show clearly that it has in fact been opened.
8. Costs must comprehend alternate methods to achieve a tamper-resistant/evident package.
9. Package must meet FDA and health department standards.

The prior art has addressed some of the criteria. Prior art which addresses some of the foregoing criteria is as follows:

U.S. Pat. No. 2,066,708
U.S. Pat. No. 3,601,273
U.S. Pat. No. 3,746,199
U.S. Pat. No. 3,753,511
U.S. Pat. No. 3,913,771
U.S. Pat. No. 4,024,976
U.S. Pat. No. 4,190,175
U.S. Pat. No. 4,244,479
U.S. Pat. No. 4,474,304
U.S. Pat. No. 4,602,718

The tamper-evident lids of the present invention overcome the shortcomings of the prior art and fulfill the criteria listed above for an ideal tamper-evident lid.

BRIEF DESCRIPTION OF THE INVENTION

The present invention provides a lid which has a plurality of tamper-evident assemblies mounted upon a ring which circumscribes the periphery of the lid. The tamper-evident assemblies are adapted to engage the containers. The tamper-evident assemblies are adapted to flex without fracturing when the lid is affixed to the container, but the tamper-evident assemblies fracture away from the lid when the lid is lifted or removed from the mouth of the container. The lid is provided with openings which give visible evidence of tampering. In one embodiment, the tamper-evident assemblies are attached to a tear away ring which facilitates removal of all of the tamper-evident assemblies from a lid. The lid may be reclosed to provide a seal sufficient to preserve the freshness of the product within the package.

BRIEF DESCRIPTION OF THE DRAWINGS

The foregoing and additional objects, features and advantages of the present invention will become apparent to those skilled in the art, from a consideration of the following detailed description of the preferred embodiment thereof, taken with the accompanying drawings, in which.

DETAILED DESCRIPTION OF THE DRAWINGS

Figure 2:
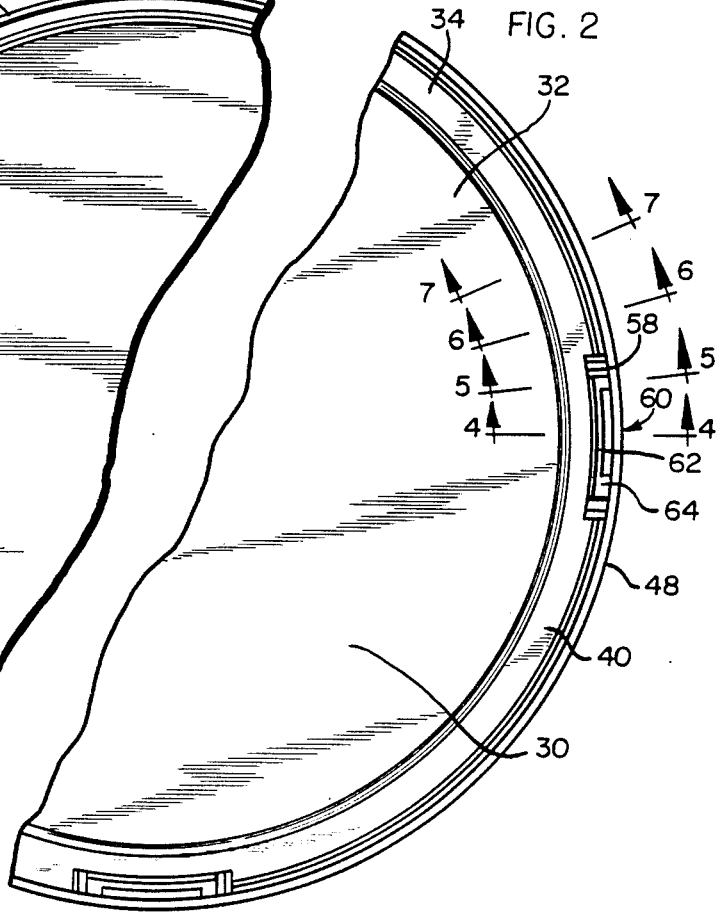
FIG. 2 is a partial top view of the lid of the present invention.
Figure 4:
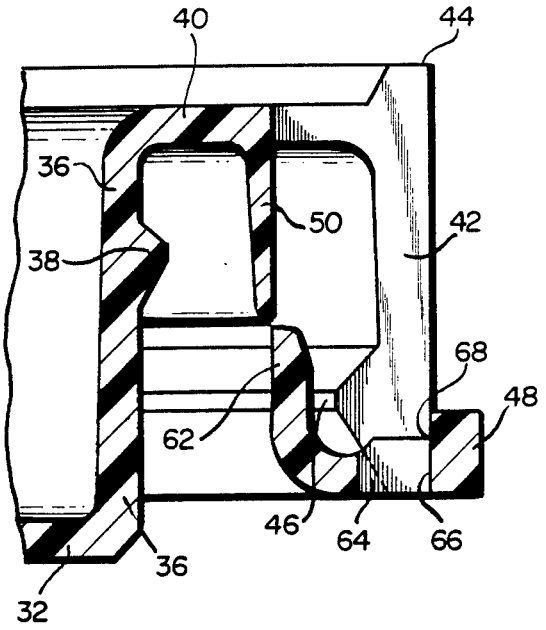
FIG. 4 is a partial side view of the lid taken in section at 4—4 of FIG. 2.
Figure 5:
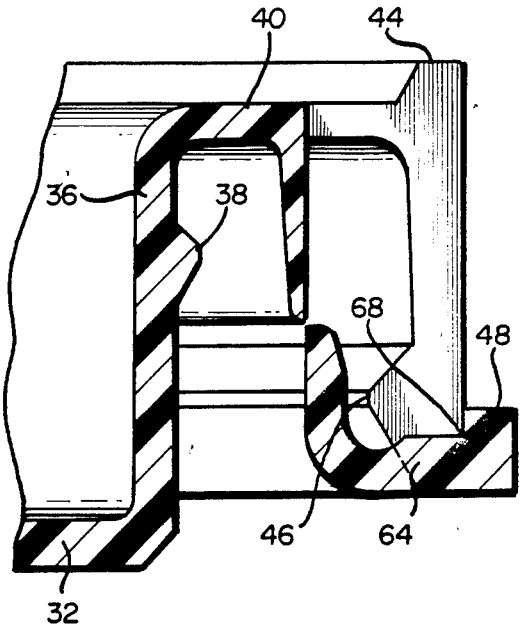
FIG. 5 is a partial side view of the lid taken in section at 5—5 of FIG. 2.
Figure 6:
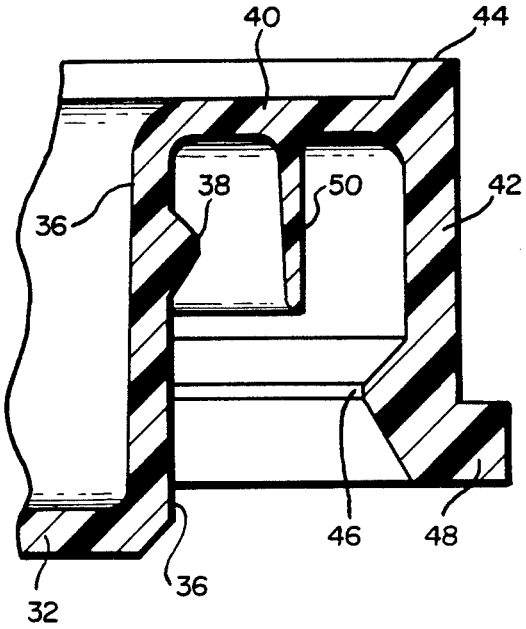
FIG. 6 is a partial side view of the lid taken in section at 6—6 of FIG. 2.

The present invention is directed to a closure system which comprises a container and a lid. The lid 30 is provided with a plurality of tamper evident-assemblies 60 disposed around the periphery of the lid. FIG. 2 is the partial top view which illustrates one tamper evident assembly 60 of the several tamper-evident assemblies which, for example, may be disposed at 90 degree intervals about the periphery of the lid 30. A greater or lesser number of tamper-evident assemblies 60 may be used.

Figure 3:
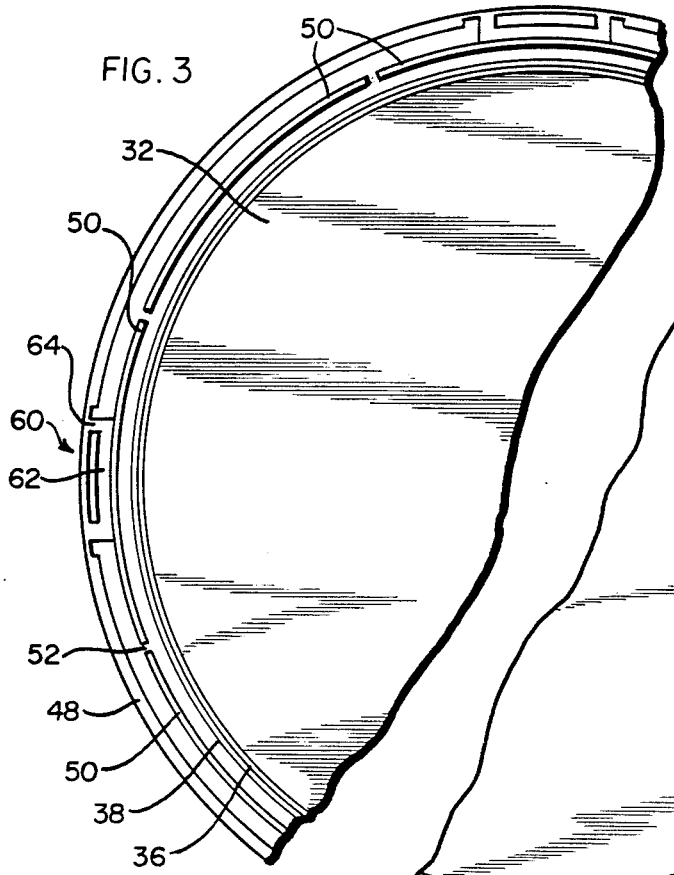
FIG. 3 is a partial bottom view of the lid of the present invention.

The top of lid 30 is shown, generally, in FIG. 2, while the bottom is shown, generally, in FIG. 3. It comprises closure surface 32 which closes the mouth of the container to which it is applied. Cross-sectional views of the container-engaging portion 34 of the lid, including tamper-evident assembly 60, are shown in detail in FIGS. 4-5 and 8-9. The container-engaging portion 34 of the lid 30 generally comprises inner flange 36, upper rim 40, and outer flange 42.

Inner flange 36 circumscribes closure surface 32 and projects upwardly therefrom. Inner flange 36 fits snugly within the sidewall 12 of the container. Bead 38, mounted on the outer surface of the inner flange 36, cooperates with container sealing bead 18 along sidewall 12 of the container 10, as can be seen from FIG. 11. In the embodiment shown in FIG. 11 (FIGS. 8 through 11), inner flange 36 of the lid 30 is vertical, while the sidewall 12 of the container 10 is tapered away from vertical. In this embodiment, bead 38 forms a mechanical interlock with the container sealing bead 18 at the upper edge of sidewall 12 of container 10, and preferably forms an airtight seal.

Upper rim 40 extends outwardly from the upper edge of inner flange 36, continuously about the circumference of the lid. The outer portion of upper rim 40 includes an opening 58 or cutaway in the area of the tamper-evident assembly 60. As can be seen from FIG. 2, opening 58 permits visual observation of tamper-evident assembly 60 and hook member 62 to determine that they are still in place. Stacking rim 44 is preferably positioned about the outer edge of upper rim 40, in order to allow the lids to be stacked in transit and the packages (comprising a container and a lid) stacked when filled.

Protective skirt 50 extends downwardly from the lower side of upper rim 40 in the area of each tamper-evident assembly 60. Protective skirt 50 is interrupted with small gaps 52 at spaced intervals, for example every 45 degrees, as can be seen from FIG. 3. Protective skirt 50 provides a sanitary cover for the lip of the container in the vicinity of tamper-evident assemblies 60 which are exposed through opening 58 to provide visual evidence of tempering.

Outer flange 42 extends downwardly from the outer periphery of upper rim 40. Outer flange 42, similar to upper rim 40, is interrupted in the areas of tamper-evident assemblies 60. Preferably barb 46, projects inwardly from the lower-most portion of outer flange 42. Barb 46 is adapted to engage the lip 16 of the container 10 and maintain the lid 30 in the closed position.

Outer ring 48 is attached to the lower edge of outer flange 42, and extends about the periphery of the lid 30. Outer ring 48 serves as the permanent lid member to which the frangible, tamper-evident container engaging members are affixed. Because outer ring 48 is continuous about the periphery of the cap, it is useful in helping to stack the lids in shipment and in passing through the packaging equipment. Further, the outer ring presents the maximum diameter of the lid and of the package, and thus functions as a bumper to protect filled packages from rubbing against one another and protects the lids from damage and/or accidental opening, i.e., chiming, during transit and storage.

The tamper-evident assembly, shown generally at 60, is mounted on outer ring 48. Each tamper-evident assembly 60 comprises hook member 62 which is adapted to engage the lip 16 of the container 10. Hook member 62 is connected to ring 48 by arms 64 at joint 66. Sharp inner-upper corner 68 of joint 66 provides a situs for the fracturing of the arms 64 from the ring 48 in the event arms 64 are deflected downwardly, as in opening the containers, when the lid is removed from the container or in the event of tampering. The absence of a sharp corner on the lower-outer portion of joint 66 allows the arms 64 to be deflected upwardly, during lid insertion, without fracturing.

The process of inserting lid 30 on container 10 is illustrated by FIGS. 8 through 11. In those FIGURES the container is shown, generally, at 10. Container 10 comprises a vertical or slightly tapered sidewall 12 which forms an annular body. The mouth of the container 10 which is closed by lid 30 is defined by the top edge 14 of vertical sidewall 12. Top edge 14 includes lip 16 which is downwardly turned on the outer side of sidewall 12. Preferably bead 18 is disposed inwardly on sidewall 12 at top edge 14 where bead 18 cooperates with bead 38 of lid 30 to form a seal.

Figure 7:
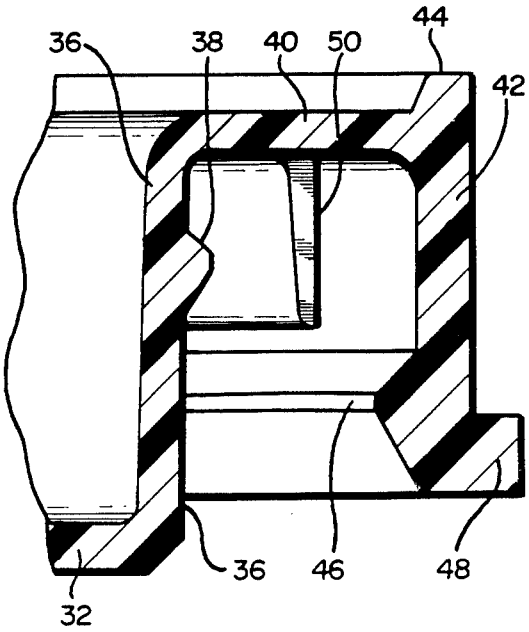
FIG. 7 is a partial side view of the lid taken in section at 7—7 of FIG. 2.

FIG. 7 shows a lid 30 aligned above container 10, ready to be applied to the container.

Figure 8:
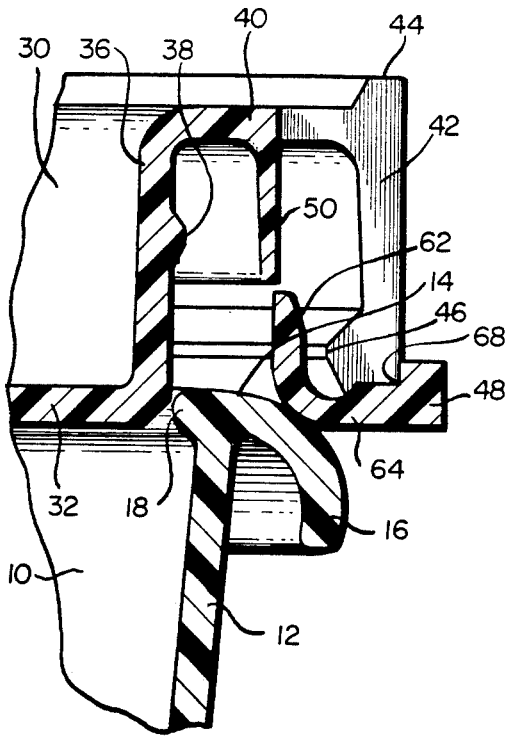
FIG. 8 is a partial side view of the lid and a container taken in section at 5—5 of FIG. 2 showing the lid in position for insertion on the container.
Figure 9:
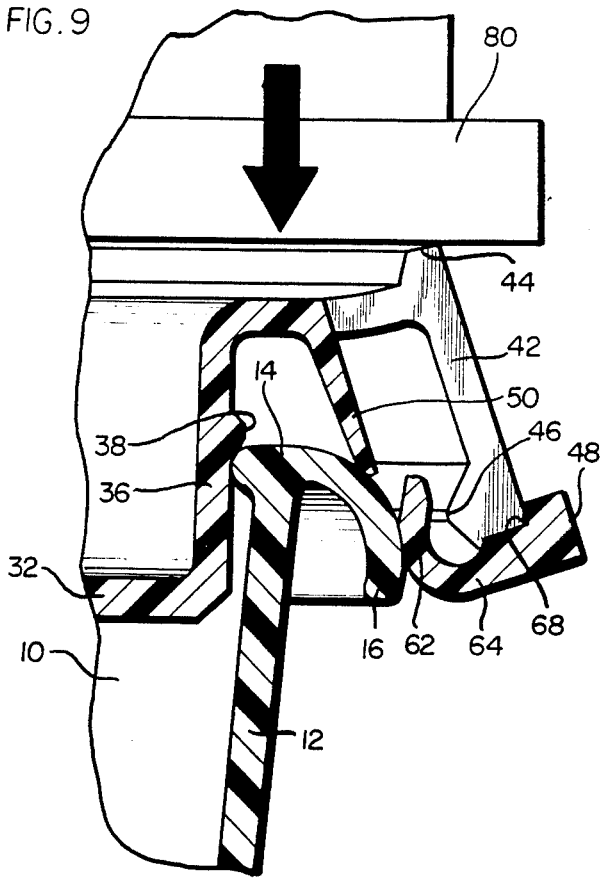
FIG. 9 is a partial side view of the lid and a container taken in section at 5—5 of FIG. 2, wherein the lid is partially inserted on said container.

As is shown in FIG. 8, capping plate 80 moves downwardly to force lid 30 into container 10. If desired, the container 10 may be supported during the lid application by a filling cup, which surrounds container 10 and extends into the opening beneath lip 16. As the capping plate 80 is lowered, as is shown in FIG. 8, the outer flange 42 along with the associated outer ring 48 are resiliently deflected outwardly as barb 46 passes over lip 16 of container 10. Simultaneously, tamper-evident assembly 60 is resiliently deflected upwardly and outwardly to allow hook member 62 of tamper-evident assembly 60 to pass outside of lip 16. At this position, protective skirt 50 is resiliently deflected outwardly along the surface of lip 16.

Figure 10:
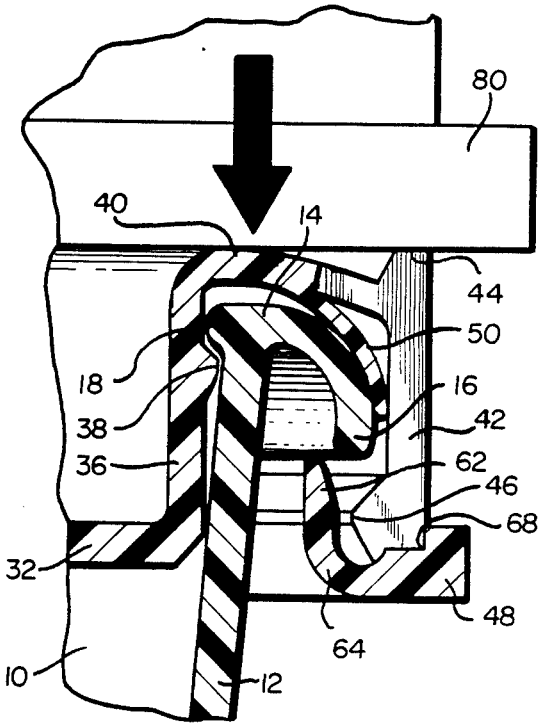
FIG. 10 is a partial side view of the lid and a container take in section at 5—5 of FIG. 2 showing the lid in the full down position on said container.

The downward movement of capping plate 80 is continued until the maximum down position, shown in FIG. 10, is reached. At the maximum down position shown in FIG. 10, sealing skirt 50 is resiliently deflected outwardly to an extreme and hook member 62 is positioned beneath the lower edge of rim 16. This allows outer flange 42 and outer ring 48 to recover from the deflected positions and resiliently return to their original positions, which causes hook member 62 to move inside the periphery of lip 16.

Figure 11:
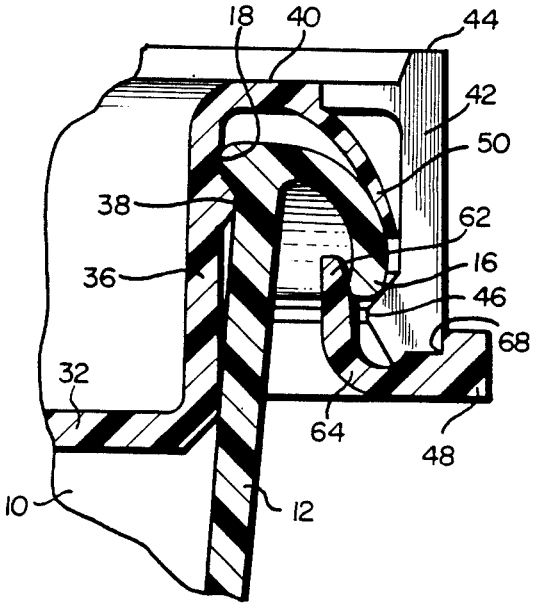
FIG. 11 is a partial side view of the lid and a container taken in section at 5—5 of FIG. 2 showing the lid in its closed, sealed position on the container.

As capping plate 80 is raised, sealing skirt 50 recovers from its extreme deflection and urges lid 30 upwardly and causes lid 30 to assume its sealed position, as is shown in FIG. 11. In the sealed position, hook member 62 locks onto the lower edge of lip 16. Lip 16 is locked between the hook member 62 and barb 64, affixed to the innermost edge of outer flange 42. Protective skirt 50 cooperates with lip 16 to form a resilient seal. Bead 18 on the container 10 and bead 38 on the lid 30 interlock to form an air-tight seal.

Figure 1:
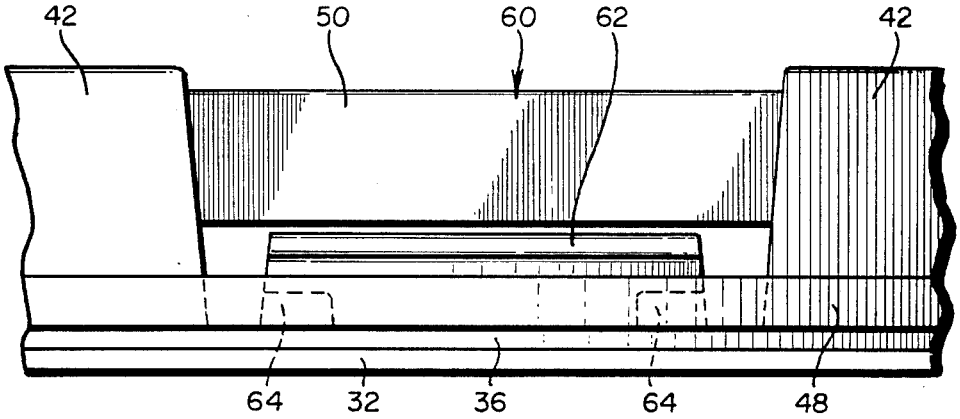
FIG. 1 is a partial side view of the lid of the present invention.
Figure 12:
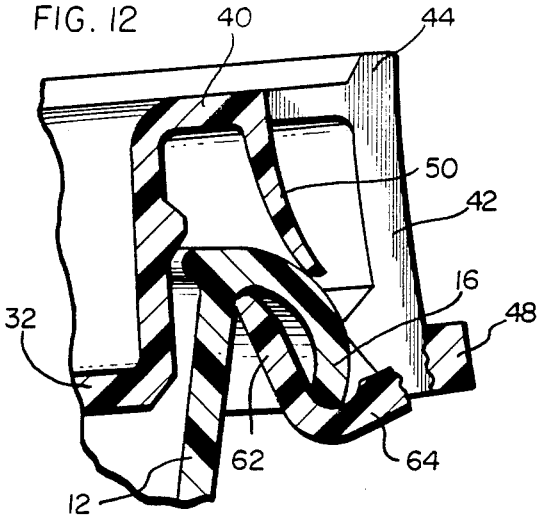
FIG. 12 is a partial side view of the lid and a container taken in section at 5—5 of FIG. 2 showing removal of the lid with the tamper-evident assembly fracturing as the package is opened.

When the lid of the present invention is removed from the container or the package is partially opened, the hook member 62 fractures away from ring 48 at joint 66, as is shown in FIG. 12. Because joint 66 has a sharp inner-upper corner 68, deflection of the hook member 62 is enough to allow it to be removed from lip 16, and will cause joint 66 to be fractured. As can be seen from FIG. 1, when the absence of the hook member 62 (which is an indication of tampering) from the package is readily apparent upon inspection of the package.

Figure 13:
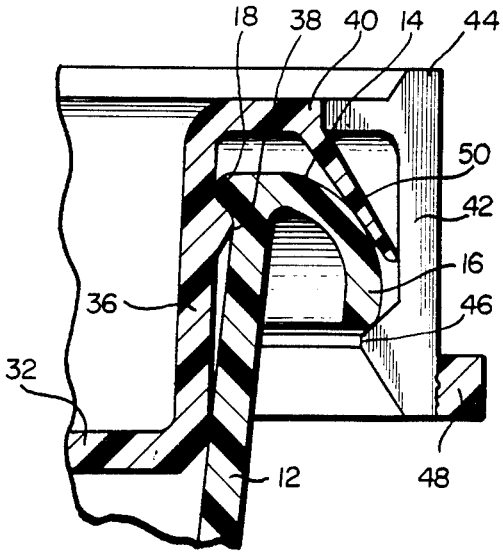
FIG. 13 is a partial side view of the lid and a container taken in section at 5—5 of FIG. 2 showing the lid with the lid reclosed and resealed on the container.

The lid of the present invention may be reapplied to the container, as is shown in FIG. 13. When the lid 30 is reinserted on the container 10, a seal is formed by interlocking beads 18 and 36, thus locking the package in the closed position and maintaining an air-tight seal. A sanitary cover is formed where skirt 50 is in contact with lip 16 in the areas adjacent to the tamper-evident assembly 60. Additional locking forces are provided by barb 46 which engages the lower edge of lip 16 to help maintain the lid in the closed position.

Figure 14:
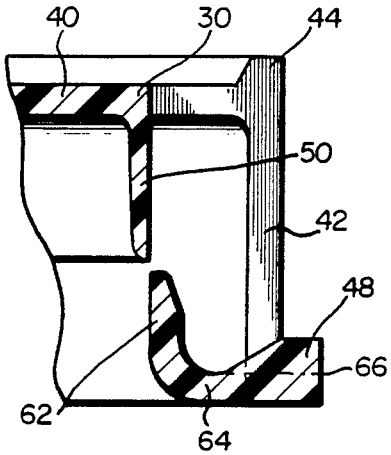
FIG. 14 is a partial side view of the lid and a container taken in section at 5—5 of FIG. 2 showing the lid with a modified container engaging member.
Figure 15:
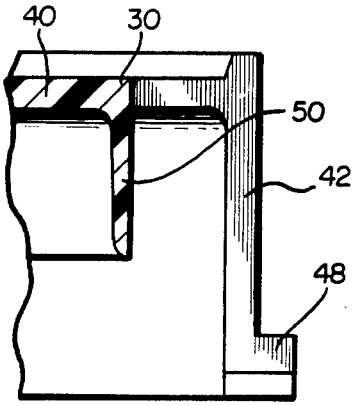
FIG. 15 is a partial side view of the lid and a container taken in section at 6—6 of FIG. 2 showing the lid with a modified container engaging member of FIG. 3 removed.

FIG. 14 illustrates another embodiment of lid 30, wherein a container engaging assembly is attached to ring 48 through a modified joint 66. FIG. 15 shows this embodiment, wherein the tamper-evident assembly 60 has been broken off, thus creating an interruption in ring 48.

Figure 16:
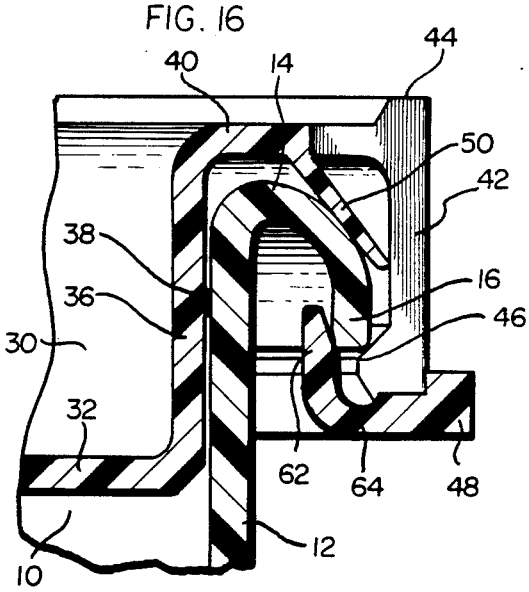
FIG. 16 is a partial side view of the lid and a container taken in section at 5—5 of FIG. 2 showing another embodiment of the lid in the closed and sealed position on the container.

FIG. 16 illustrates another embodiment of the present invention, wherein modified container 10 has a smooth inner sidewall 12, i.e., no sealing bead 18, as is shown in the container illustrated in FIGS. 8 through 13. In the embodiment shown in FIG. 16, wherein inner flange 36 of lid 30 is vertical and parallel to container vertical sidewall 12, no interlock is formed by bead 38, but bead 38 does function as an airtight seal where it abuts vertical sidewall 12 of the container. In the embodiment of FIG. 16, lid 30 has a modified bead 38 disposed on the outer periphery of inner flange 36, wherein it forms a seal with vertical sidewall 12 of the container. The embodiment illustrated by FIG. 26 is otherwise similar to the embodiment shown in FIGS. 8 through 13

Figure 17:
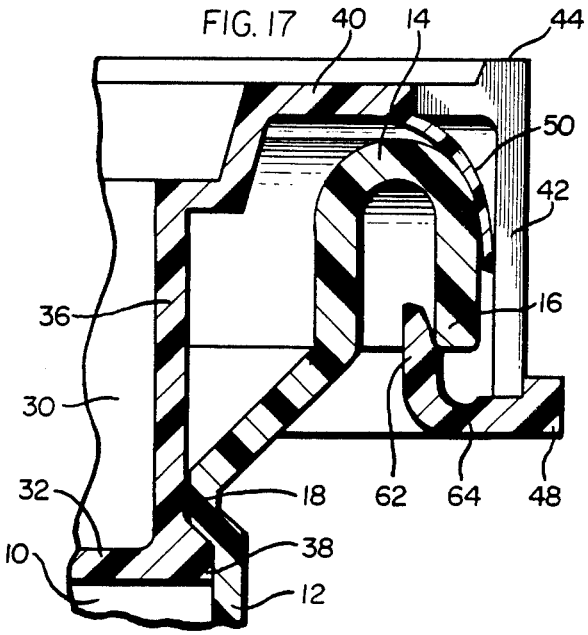
FIG. 17 is a partial side view of the lid and a container taken in section at 5—5 of FIG. 2 showing another embodiment of the lid with the lid closed and sealed on a container.

FIG. 17 illustrates yet another embodiment, wherein lid 30 is closed upon a modified container 10. In this embodiment, container 10 has a modified bead 18 formed in vertical sidewall 12. Shoulder 13 which extends above bead 18 and is connected to top edge 14. In order to accommodate the container shown in FIG. 17, the closure surface 32 of lid 30 is extended to form an annular bead 38 which forms a seal against the side 12 of container 10. Bead 38 also cooperates with container bead 18 to form a mechanical interlock around the periphery of the container. The embodiment shown in FIG. 17 is otherwise similar to the embodiment shown in FIGS. 8 through 13.

Figure 18:
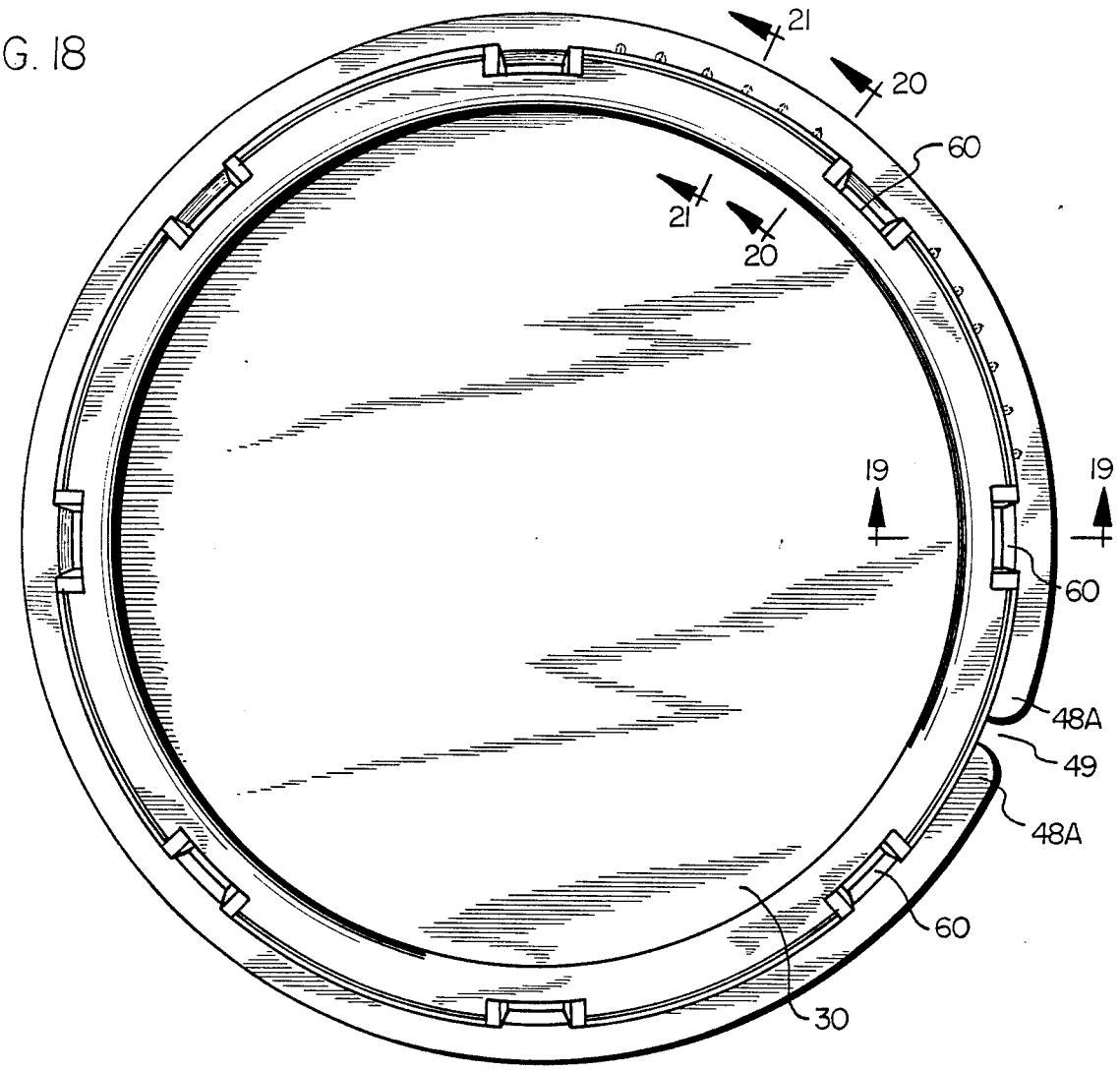
FIG. 18 is a top view of the lid of the present invention showing the tear-away ring embodiment.

FIGS. 18 through 23 illustrate another embodiment wherein the tamper-evident assemblies are affixed to an interrupted, tear-away ring 48A which is frangibly attached to the downward projecting portions 42. Removal of ring 48A removes all of the tamper-evident assemblies from the lid 30 in a single motion. In this embodiment, it is preferred that the ring 48A have at least one interruption 49, as shown in FIG. 18.

Figure 22:
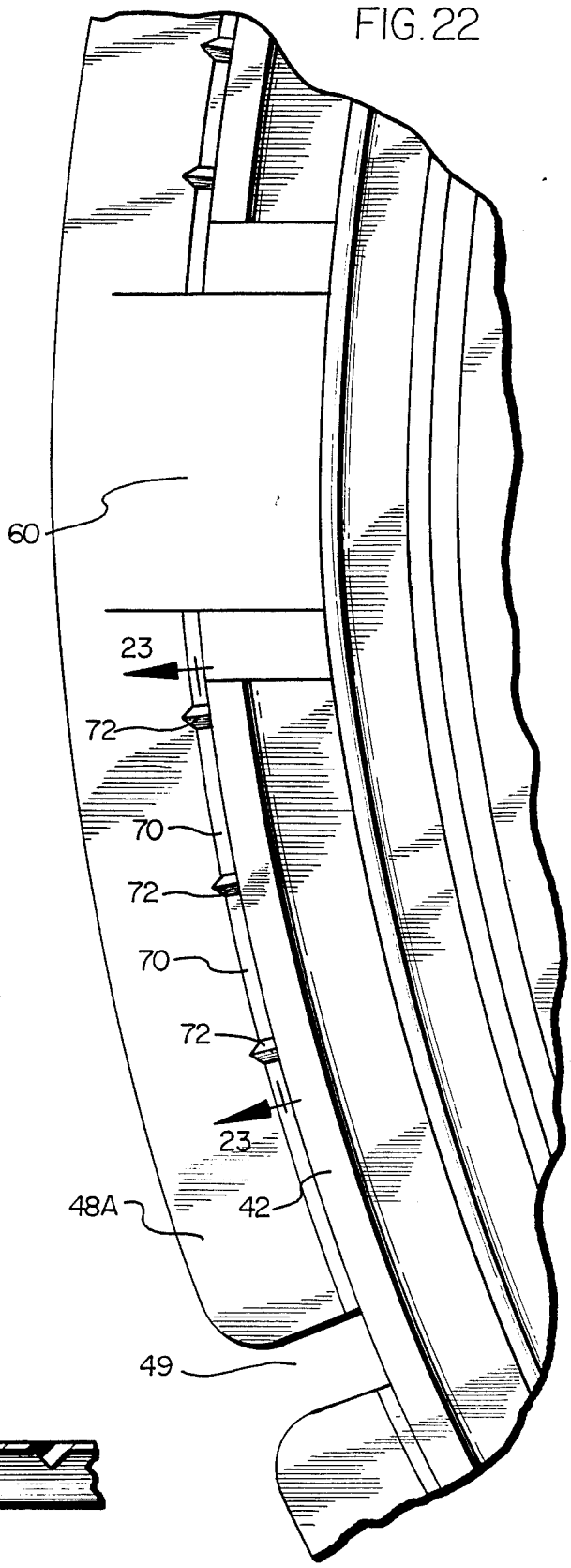
FIG. 22 is a partial bottom view of the lid of the present invention of the tear away ring embodiment.
Figure 23:
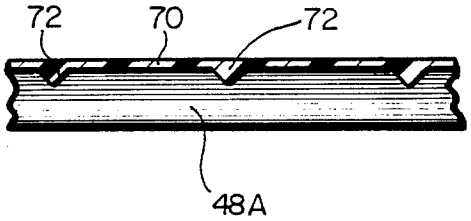
FIG. 23 is a partial side view of the lid of the tear away ring embodiment taken in section 23—23 of FIG. 22.

In this embodiment, modified ring 48A is frangibly connected to the downwardly projecting outer flange 42. Preferably, the modified ring 48A is joined to flange 42 by a plurality of radial ribs 72 which are spaced about the periphery of the lid. The spaces 70 between the radial ribs 72 can be merely flashing 70 resulting from the molding procedure, or can be openings, i.e., devoid of plastic. It is not necessary that flashing 70 provide any strength to the assembly. Radial ribs 72 provide the frangible joint between the modified tear-away ring 48 and the downwardly projecting flange 42. Radial ribs 72 may be spaced evenly about tear-away ring 48A. Preferably, radial ribs 72 are placed closely adjacent to the sides of each tamper-evident assembly 60, as shown in FIG. 22. Preferably, radial ribs 72 are spaced a distance from interruption 49 of ring 48A, as shown in FIG. 22, in order to facilitate grasping ring 48A for removal. Radial ribs 72 allow the hooks 62 to deflect upwardly (and tearaway ring 48A to flex downwardly) as the lid is placed on a container. When the lid is removed from the container, hooks 62 must be flexed downwardly (which causes ring 48A to deflect upwardly) which fractures radial ribs 72. In some cases, the ribs 72 fracture and the ring 48A separates from downward projection 42, and in other cases the fracture causes the plastic to discolor. In either case, the fractured ribs 72 are readily visible, providing evidence of tampering.

Figure 19:
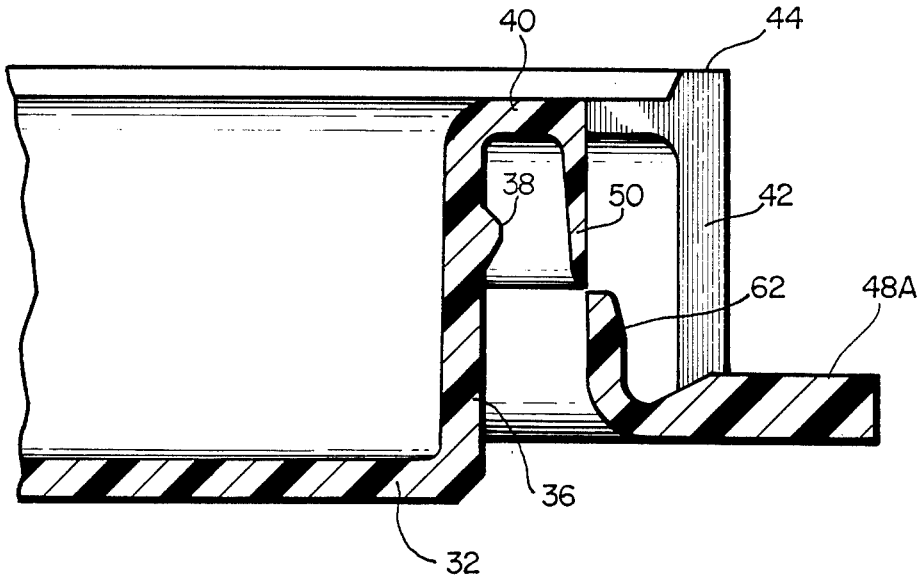
FIG. 19 is a partial side view of the lid of the tear away ring embodiment taken at section 19—19 of FIG. 18.
Figure 20:
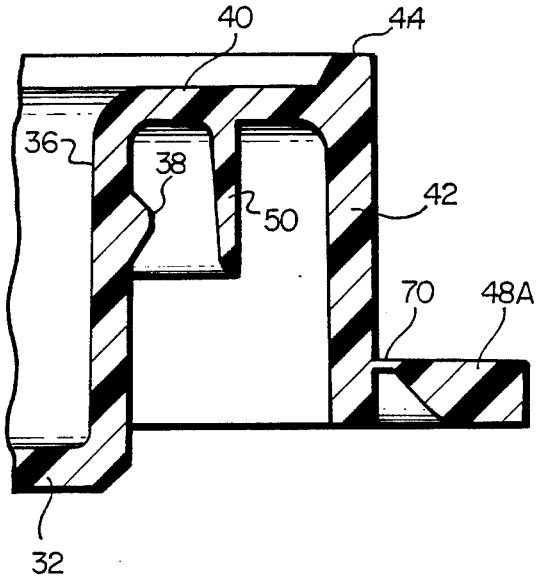
FIG. 20 is a partial side view of the lid of the tear away ring embodiment taken in section 20—20 of FIG. 18.
Figure 21:
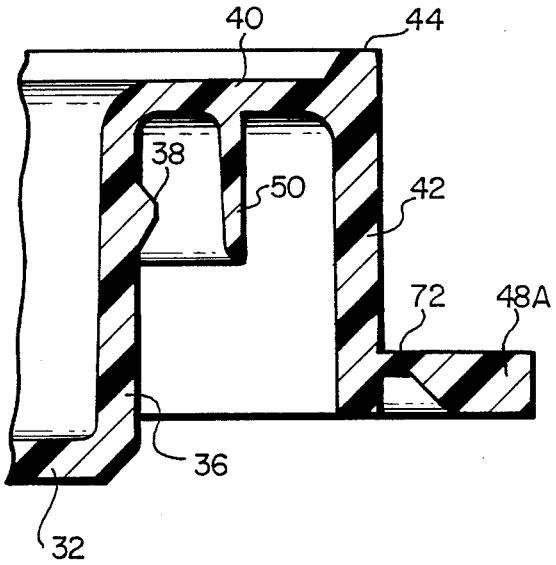
FIG. 21 is a partial side view of the lid of the tear away ring embodiment taken in section 21—21 of FIG. 18.

As is shown in FIG. 19, the hook members 62 of the tamper-evident assembly 60 are integrally molded with tear-away ring 48. This provides several indications of tampering, namely, when a package is tampered with, the fractured ribs 72 will be visible, the displacement of hook member 62 may be visible through the openings in outer flange 42, and the displacement of hook member 62 may also cause the tear-away ring to have a different orientation, thus making the tampering more readily visible. Additionally, the removal of the tamper-evident assemblies from the package by a purchaser are facilitated merely by tearing the ring 48A away from the package. The interruption 49 in ring 48A enables the user to grasp one end of the ring and remove it by breaking connectors 72, thereby removing the tamper-evident assemblies 60.

The tamper-evident lid of the present invention may take a wide variety of forms, as is illustrated by the embodiments shown in the drawings. Other types of lids may be fabricated to employ the tamper-evident assembly of the present invention.

The present invention is not limited to any specific materials of construction. While high-density polyethylene is the preferred material of construction, other notch-sensitive plastics, such as filled polypropylene, which are adequately frangible, may be used, The lids of the present invention may be formed by injection molding and other conventional processes.

It is contemplated that the tamper-evident assemblies of the present invention may be modified for employment with a wide variety of containers, including glass containers, paper cups, 2-piece cups, and various styles of threaded containers. Although the drawings which form a part of this application illustrate circular shaped containers, it is contemplated that other shapes, including ovals, may take advantage of the present invention.

The scope of the invention herein shown and described are to be considered only as illustrative. It will be apparent to those skilled in the art that numerous modifications may be made therein without departure from the spirit of the invention and the scope of the appended claims.

I claim:

1. A tamper-evident lid adapted to be used with a container, said lid comprising;

a continuous surface adapted to cover the mouth of said container, said lid having downwardly projecting portions adapted to surround the outside of the mouth of said container;

a bead associated with said continuous surface adapted to engage the side wall of said container and form a seal therewith;

a ring frangibly affixed to said downwardly projecting portions, said ring being interrupted, said ring adapted to substantially encircle the mouth of said container;

a plurality of tamper-evident assemblies affixed to said ring, each said tamper evident assembly comprising a hook member adapted to engage said container;

said downwardly projecting portions having openings in the area of each tamper-evident assembly in order to provide visual observation of said tamper evident assembly.

2. A lid as described in claim 1, wherein said ring is joined to said downwardly projecting portion by a frangible joint which allows said hook members to be deflected upwardly during insertion of the lid onto the container, but which causes said joint to fracture when said hook members are deflected downwardly.

3. A lid as described in claim 2, wherein said frangible joint comprises a plurality of radial ribs affixed to the inner side of said ring.

4. A lid as described in claim 1, comprising a sanitary cover depending from said lid and contacting said container, said sanitary cover positioned adjacent to and extending beyond both ends of said opening.

5. A tamper-evident package comprising a lid and a container;

said container having a rim defining a container mouth, said rim adapted to receive a removable lid;

a downwardly turned lid extending outwardly and downwardly from the rim of said container;

said lid comprising a continuous surface adapted to cover said container mouth, and having downwardly projecting portions adapted to surround the rim of said container;

a ring frangibly affixed to said downwardly projecting portions, said ring adapted to substantially encircle the rim of said container;

a plurality of tamper-evident assemblies affixed to said ring, each said tamper-evident assembly comprising a hook member adapted to engage the under side of said downward turned lip; and said downwardly projecting portions having openings in the area of each of said tamper-evident assembly in order to provide visual observation of said tamper-evident assembly.

6. A tamper-evident package as described in claim 5, wherein said ring is joined to said downwardly projecting portion by a frangible joint which allows said book to be deflected upwardly, but which fractures said joint when said hook is deflected downwardly.

7. A tamper-evident package as described in claim 6, wherein said frangible joint comprises a plurality of radial ribs affixed to the inner side of said ring.

8. A tamper-evident package as described in claim 6, wherein said ring is interrupted.

9. A tamper-evident package as described in claim 5, wherein said lid comprises a sanitary cover depending from said lid and contacting the lip of said container, said sanitary cover positioned adjacent to and extending beyond both ends of each said opening.

10. A tamper-evident package as described in claim 5, wherein said lid comprises an annular bead associated with said continuous surface, said bead adapted to engage the sidewall of said container and form a seal therewith.

11. A tamper-evident package as described in claim 5, wherein an inwardly directed annular bead is positioned at the upper portion of the rim of said container and an outwardly directed annular bead is positioned on a corresponding vertical member of said lid, whereby said beads cooperate to lock said lid to said container in the closed position.

* * * * *